US011992089B1

(12) United States Patent
Baker

(10) Patent No.: US 11,992,089 B1
(45) Date of Patent: May 28, 2024

(54) SHOE WITH EXPANDABLE TOP

(71) Applicant: Scott Bradley Baker, Sherman Oaks, CA (US)

(72) Inventor: Scott Bradley Baker, Sherman Oaks, CA (US)

( * ) Notice: Subject to any disclaimer, the term of this patent is extended or adjusted under 35 U.S.C. 154(b) by 0 days.

(21) Appl. No.: 16/267,130

(22) Filed: Feb. 4, 2019

Related U.S. Application Data

(63) Continuation-in-part of application No. 16/205,704, filed on Nov. 30, 2018, now abandoned, which is a continuation-in-part of application No. 16/192,530, filed on Nov. 15, 2018, now Pat. No. 11,172,733, which is a continuation of application No. 14/297,905, filed on Jun. 6, 2014, now Pat. No. 10,178,893.

(60) Provisional application No. 61/835,445, filed on Jun. 14, 2013.

(51) Int. Cl.

| | |
|---|---|
| ***A43B 3/02*** | (2006.01) |
| ***A43B 3/24*** | (2006.01) |
| ***A43B 23/02*** | (2006.01) |
| ***A43C 11/12*** | (2006.01) |
| *A43B 5/00* | (2022.01) |

(52) U.S. Cl.
CPC ..... *A43B 23/0245* (2013.01); *A43B 3/02* (2013.01); *A43B 3/242* (2013.01); *A43C 11/12* (2013.01); *A43B 5/00* (2013.01)

(58) Field of Classification Search
CPC ..... A43B 3/242; A43B 3/02; A43B 23/0245
USPC ..... 36/109
See application file for complete search history.

(56) References Cited

U.S. PATENT DOCUMENTS

| | | | | |
|---|---|---|---|---|
| 2,302,596 | A * | 11/1942 | Bigio | A43C 11/12 36/101 |
| 4,265,032 | A * | 5/1981 | Levine | A43B 3/107 36/11.5 |
| 4,628,622 | A * | 12/1986 | McBarron | A43B 11/00 36/112 |
| 7,127,837 | B2 * | 10/2006 | Ito | A43B 1/0027 36/101 |
| 7,134,225 | B2 | 11/2006 | Ashton | |
| 7,614,165 | B2 * | 11/2009 | Curry | A43B 1/0081 36/101 |
| 2005/0076536 | A1 * | 4/2005 | Hatfield | A43B 7/06 36/3 B |

FOREIGN PATENT DOCUMENTS

| | | |
|---|---|---|
| IT | 0000274252 | 12/2010 |

* cited by examiner

*Primary Examiner* — Marie D Bays

(57) ABSTRACT

A shoe comprises a sole having an upper surface with an outer edge and a lower surface. There is a top member having a distal front end portion, a proximal heel end portion, a lateral side and a medial side, the top member and sole defining a space therebetween to receive a foot. The top member further has a foot opening, a lower connective edge, a fold back portion, and a fixed portion. A single fastening means is provided in the form of one continuous zipper fastener in the top member. The top member has multiple expandable vent areas formed from a stretchable material in the top member allowing the top member to adjust in size to accommodate foot braces of many sizes and shapes.

13 Claims, 26 Drawing Sheets

Figure 1:
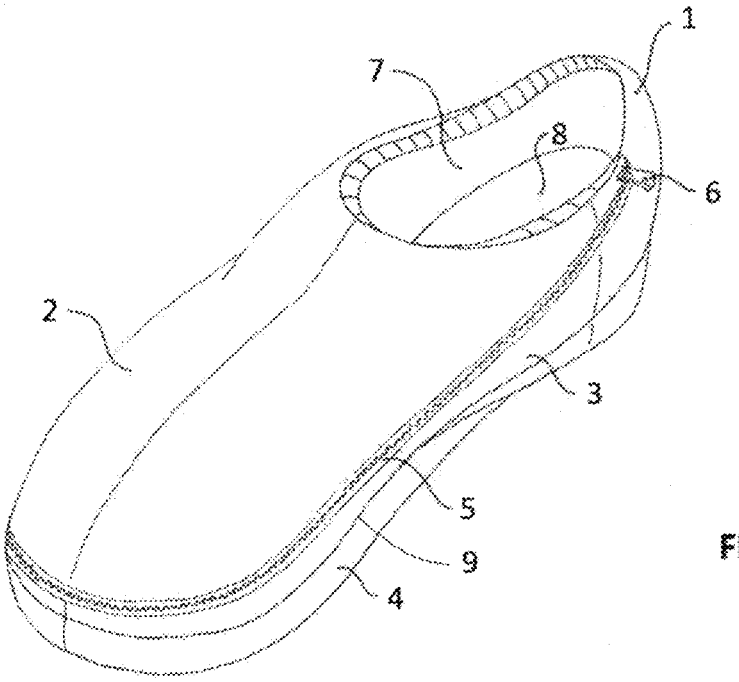
Figure 2:
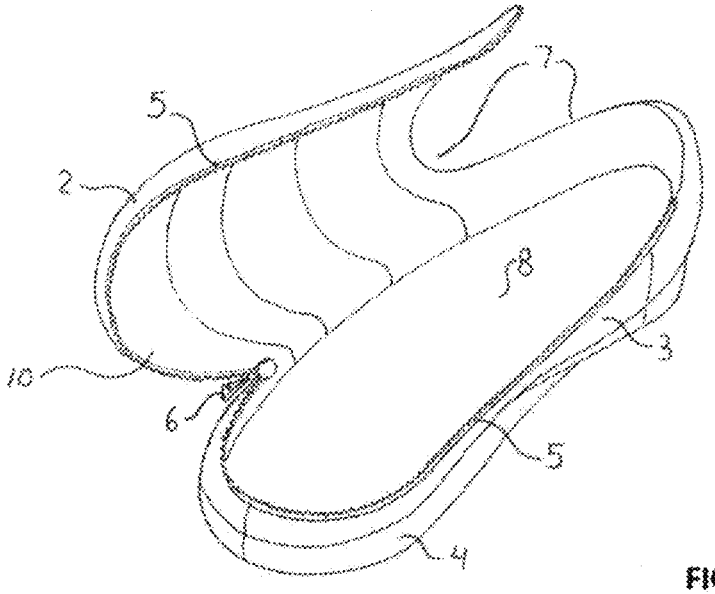
Figure 3:
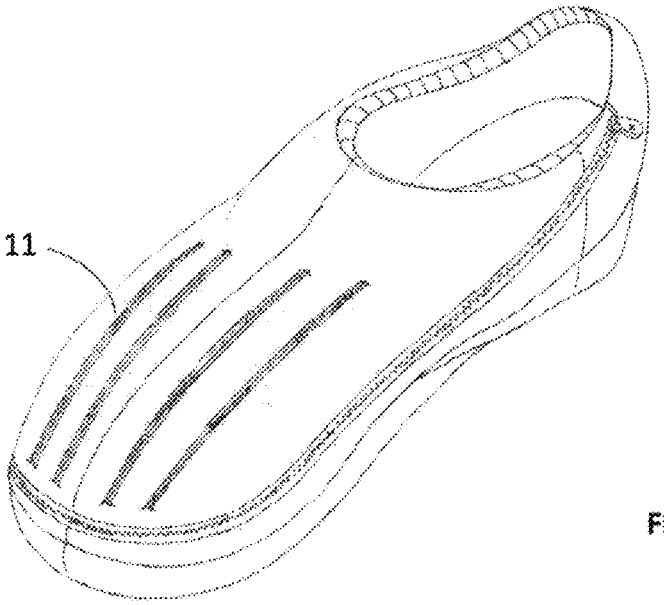
Figure 4:
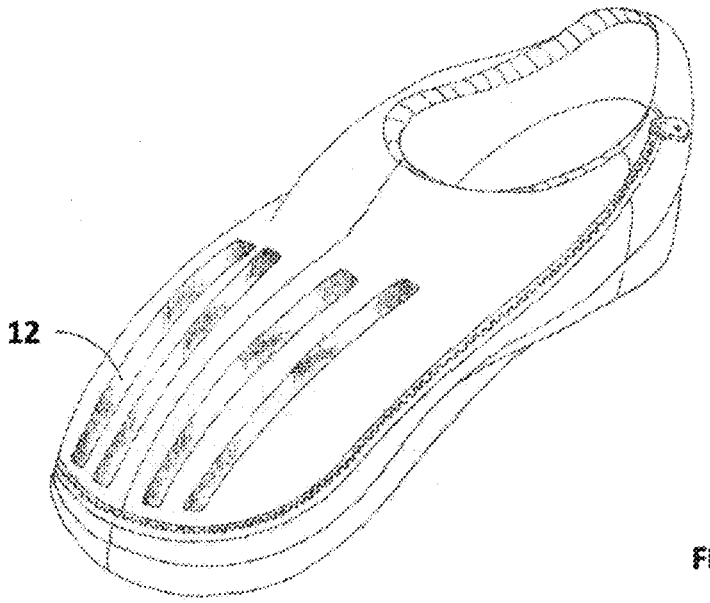
Figure 5:
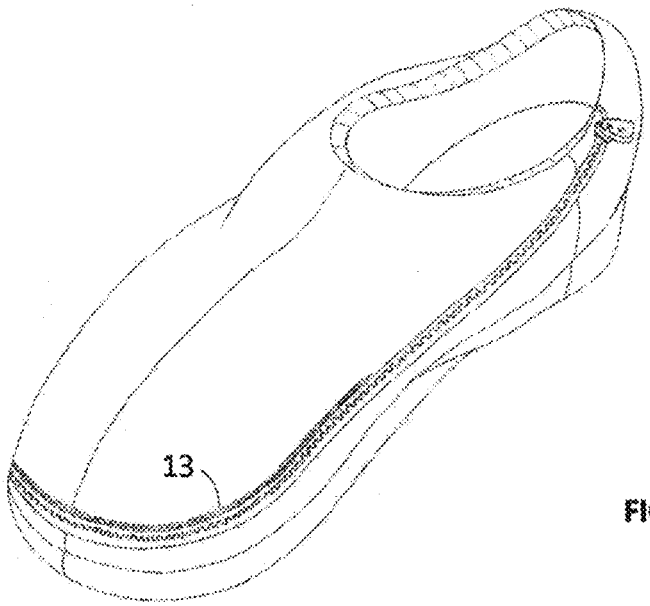
Figure 6:
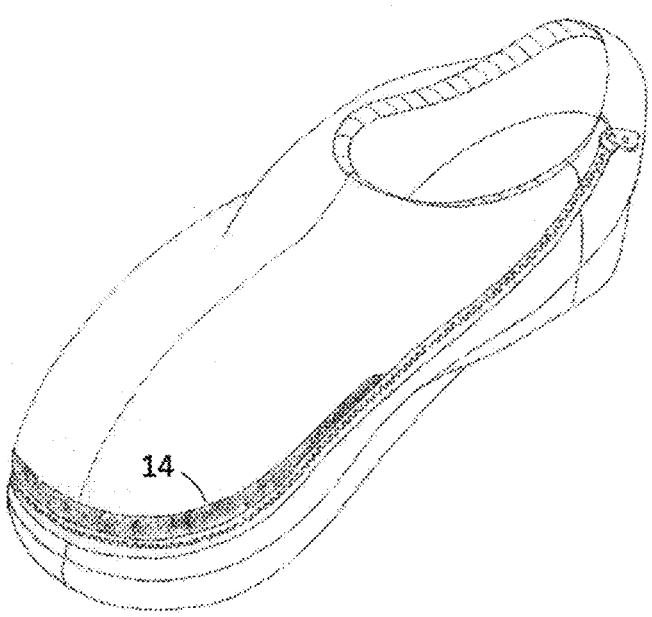
Figure 7:
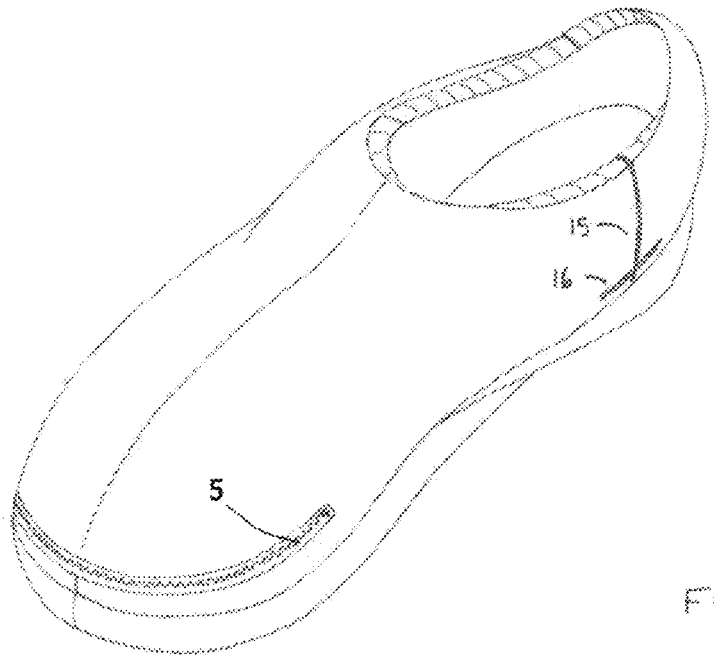
Figure 8:
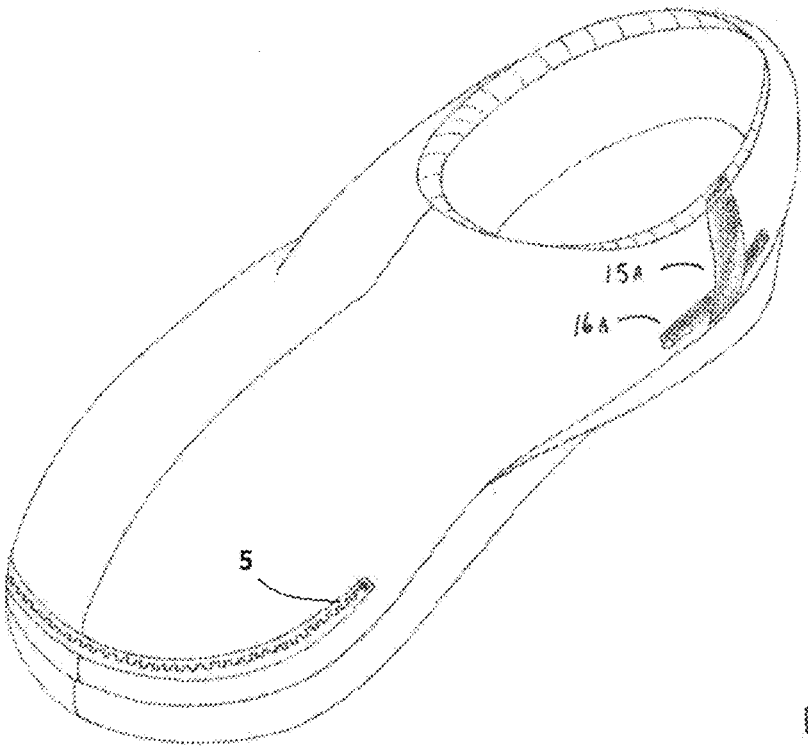
Figure 9:
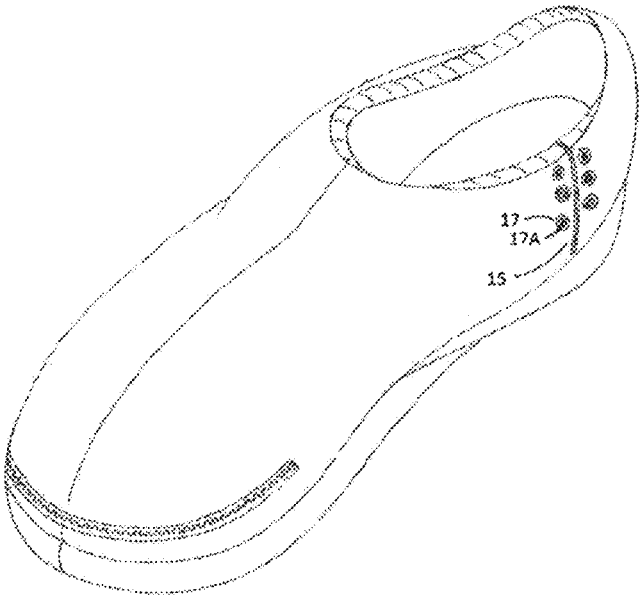
Figure 10:
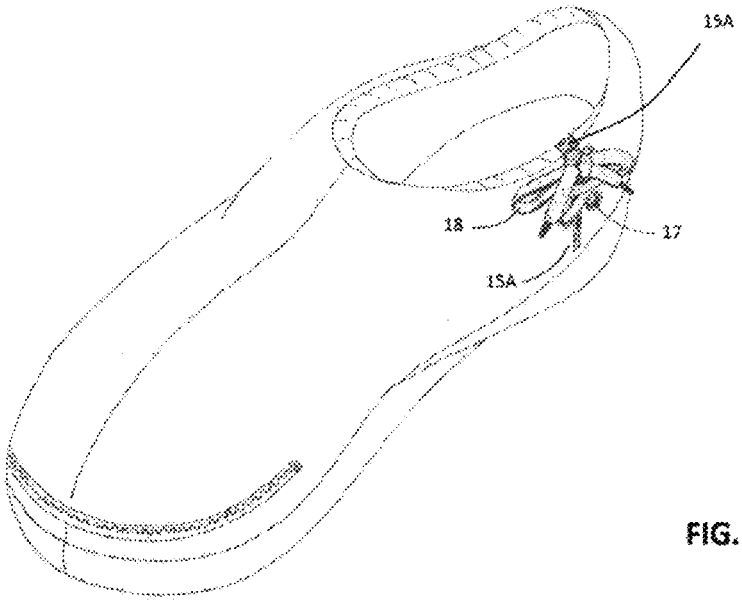
Figure 11A:
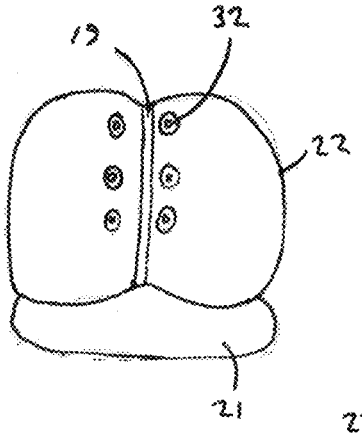
Figure 12A:
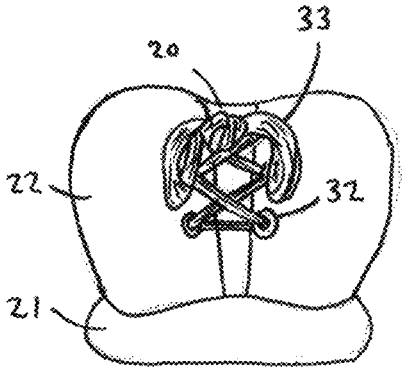
Figure 13:
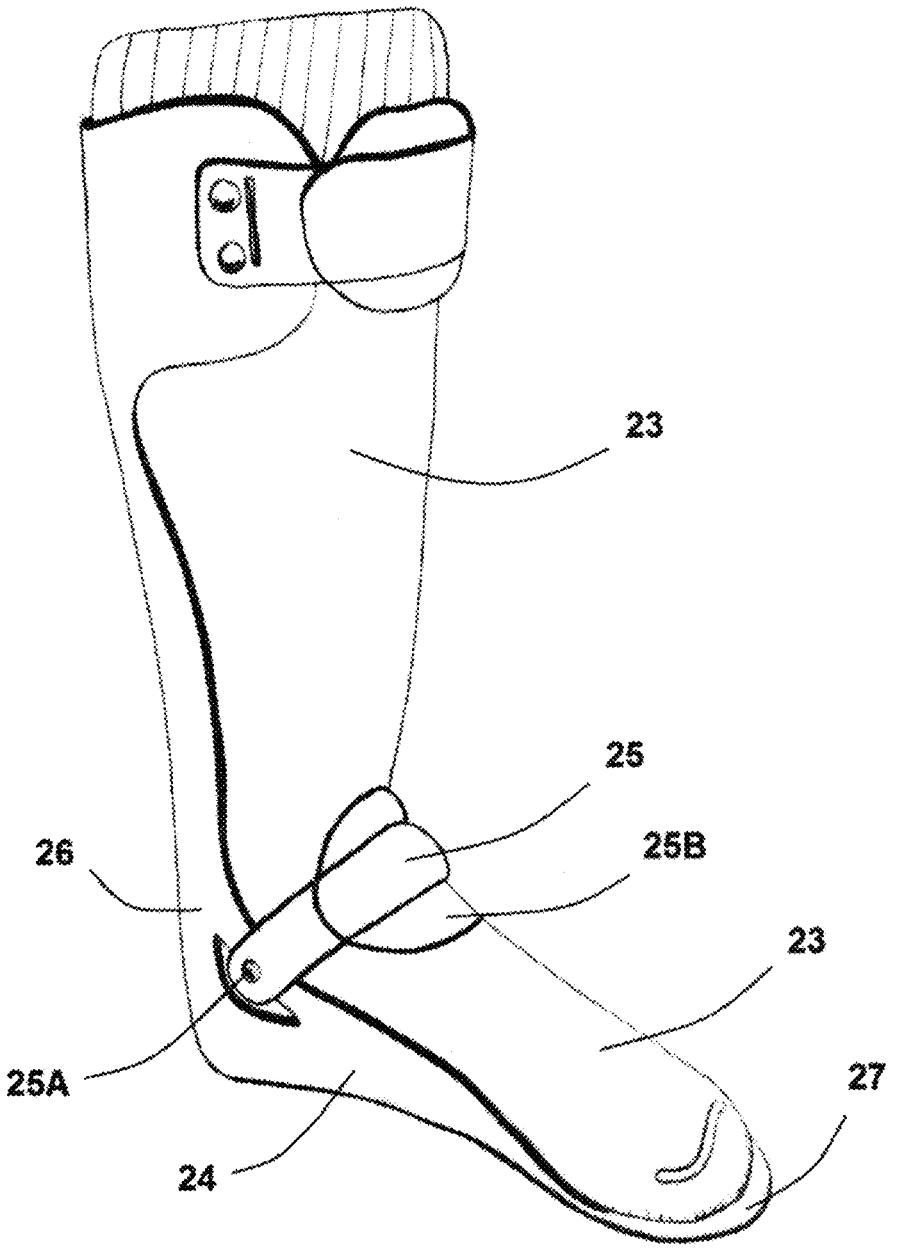
Figure 14:
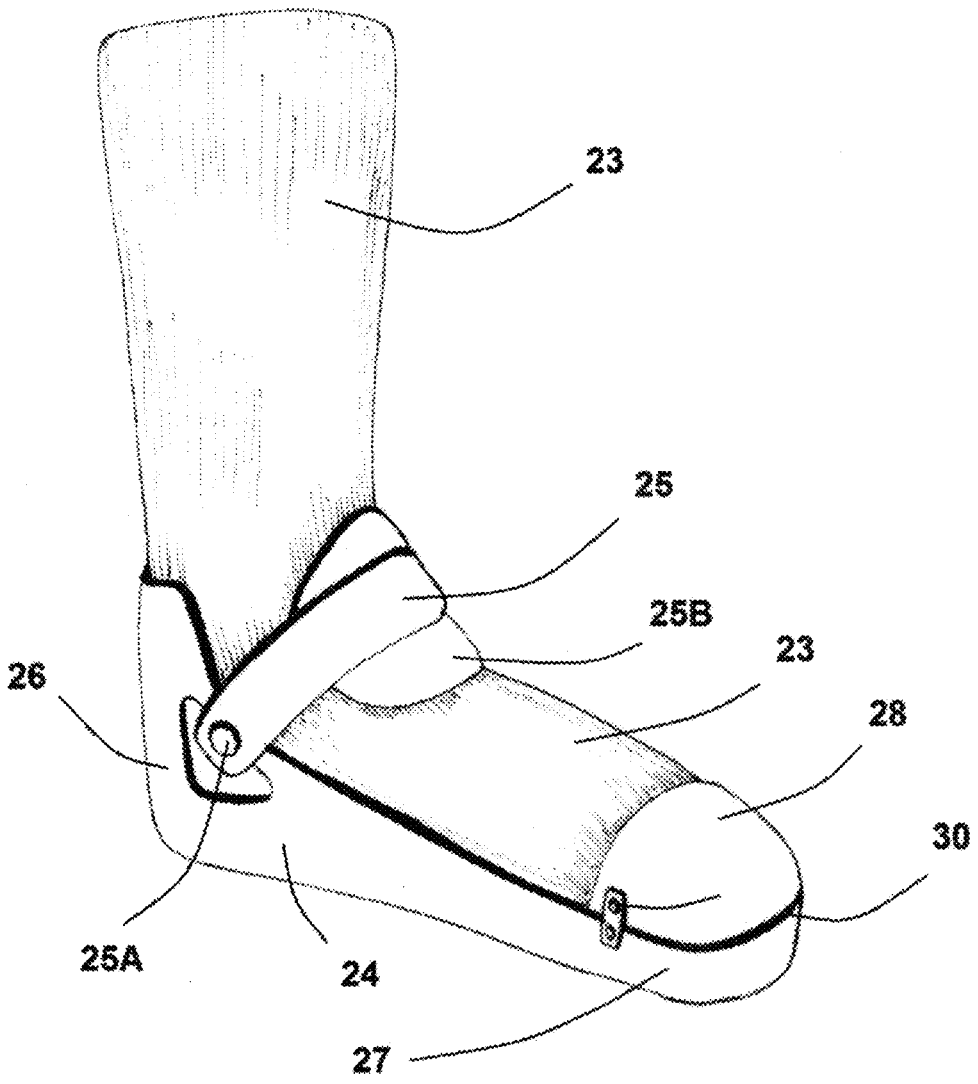
Figure 15A:
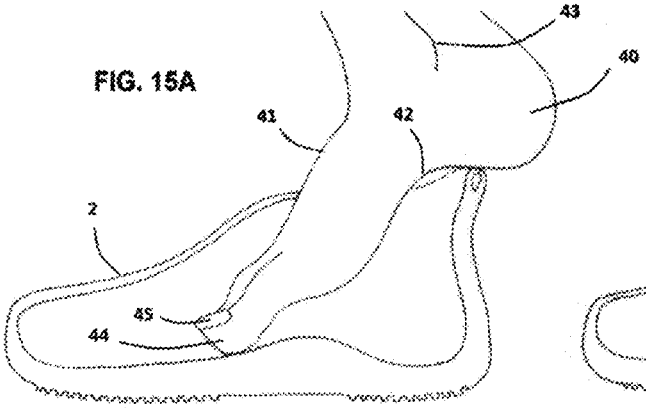
Figure 15B:
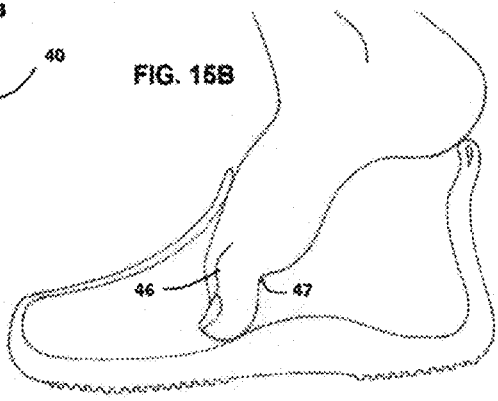
Figure 15C:
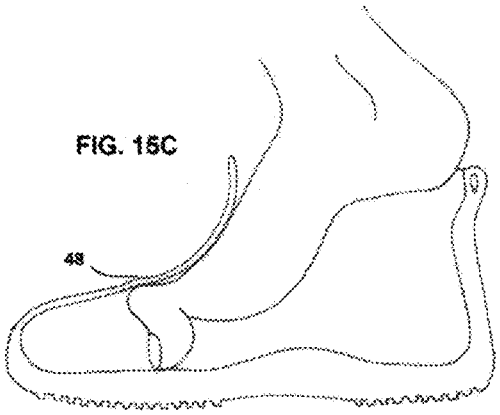
Figure 15D:
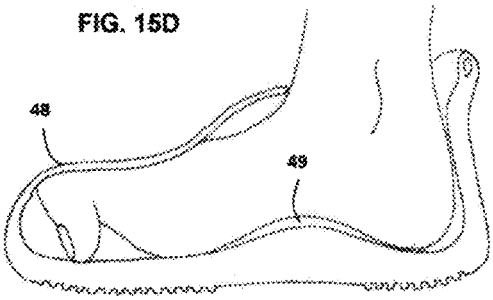
Figure 17:
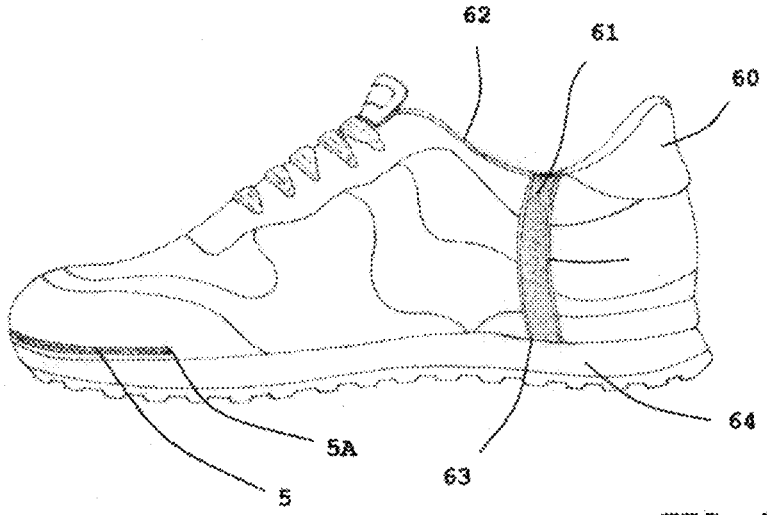
Figure 18:
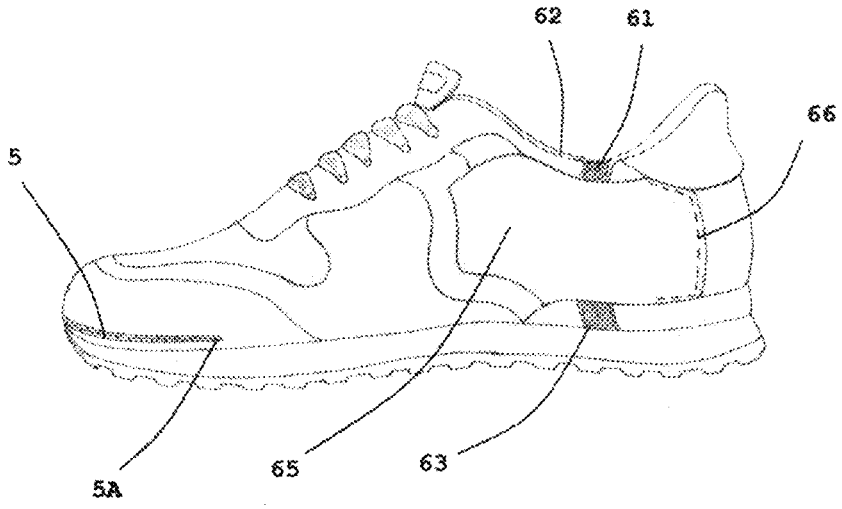
Figure 19:
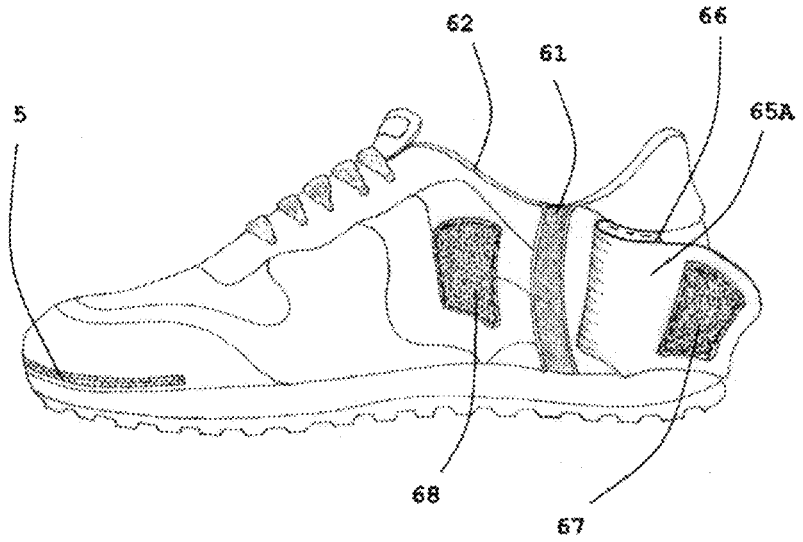
Figure 20:
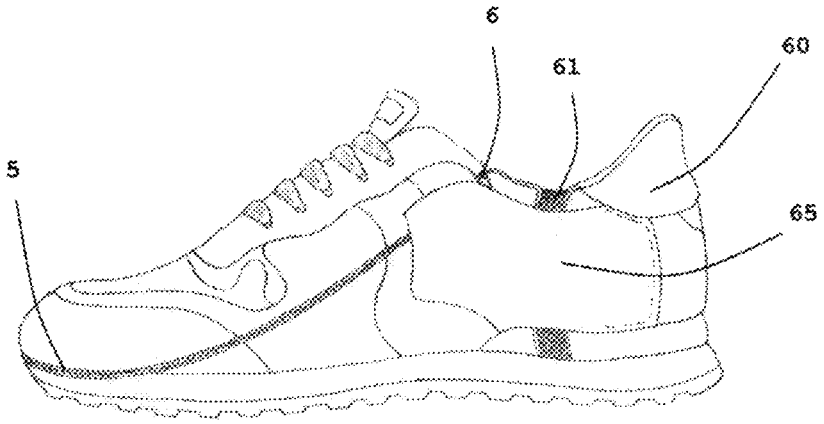
Figure 21:
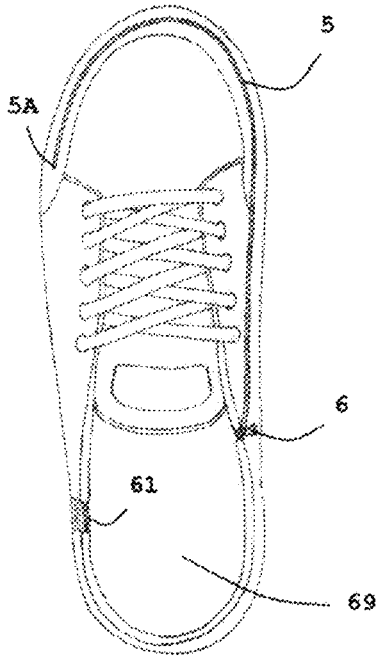
Figure 22:
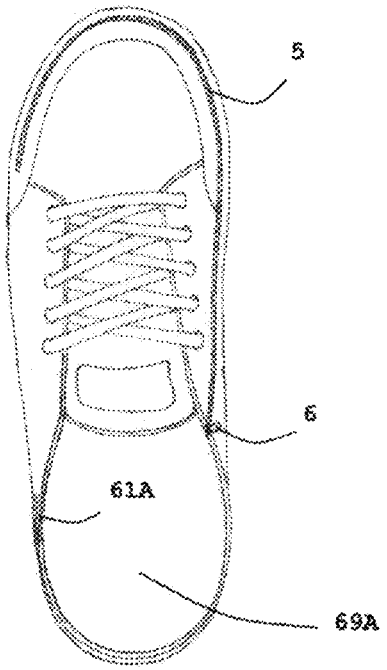
Figure 23:
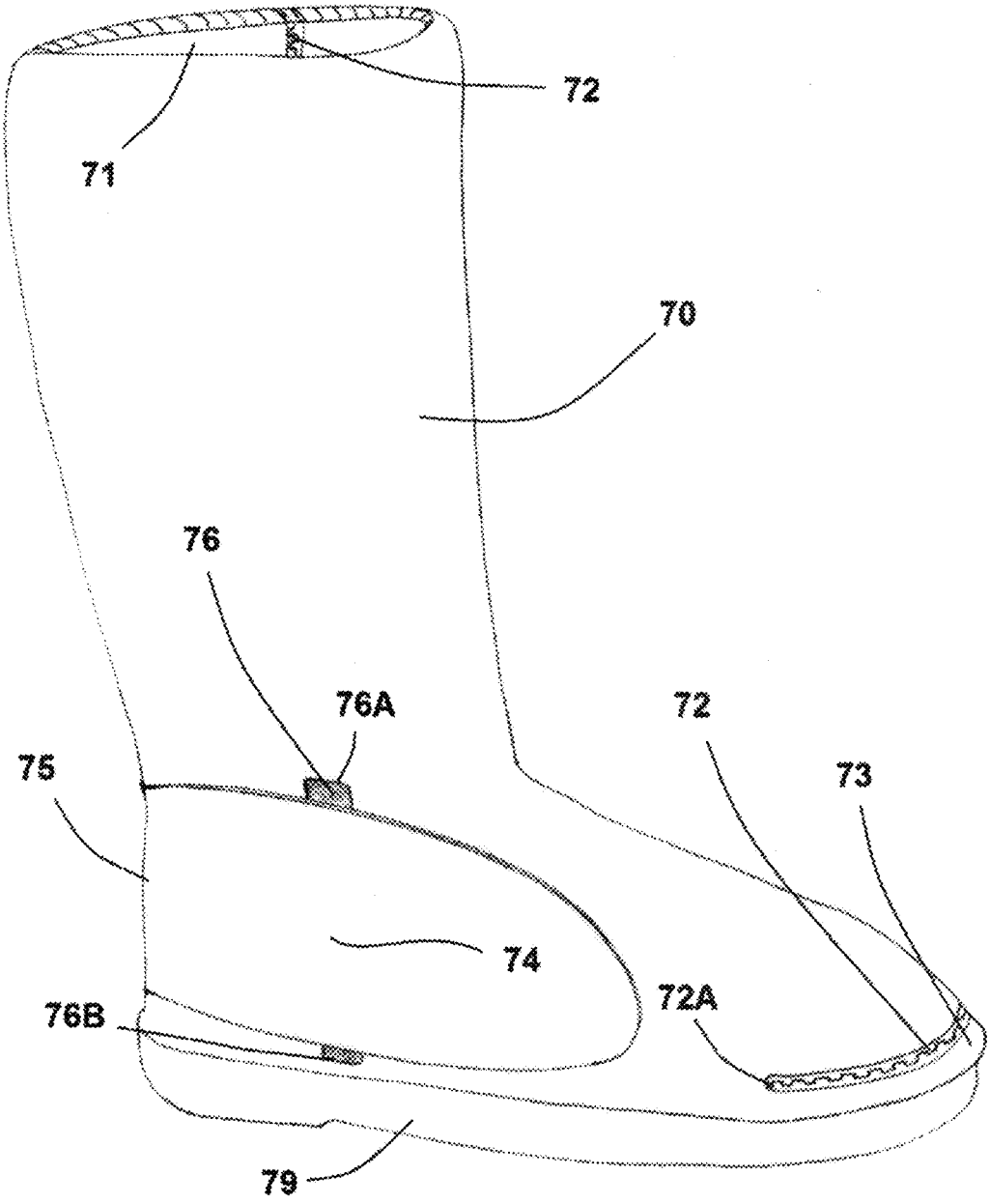
Figure 24:
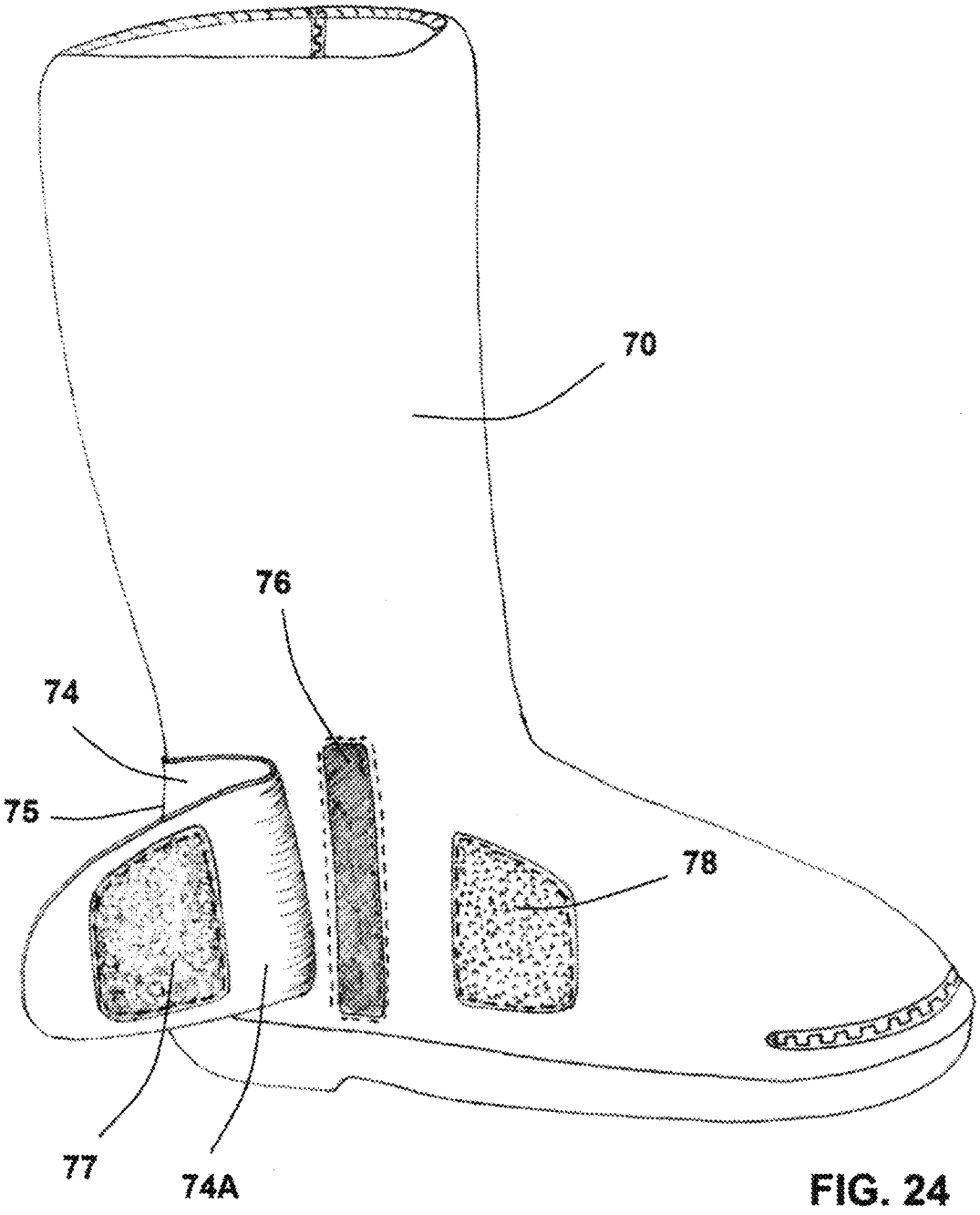
Figure 25:
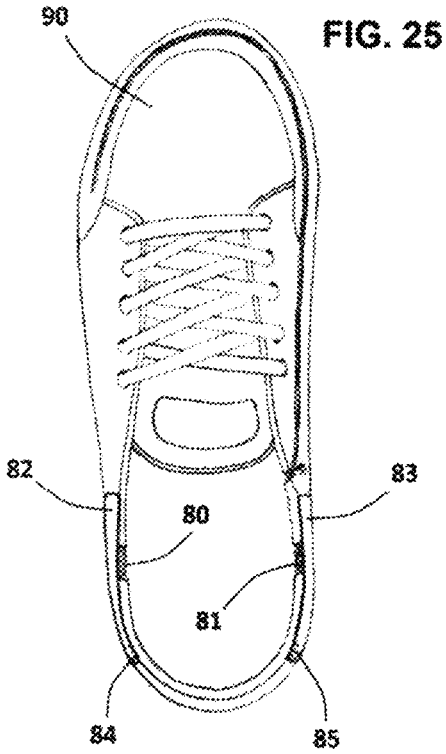
Figure 26:
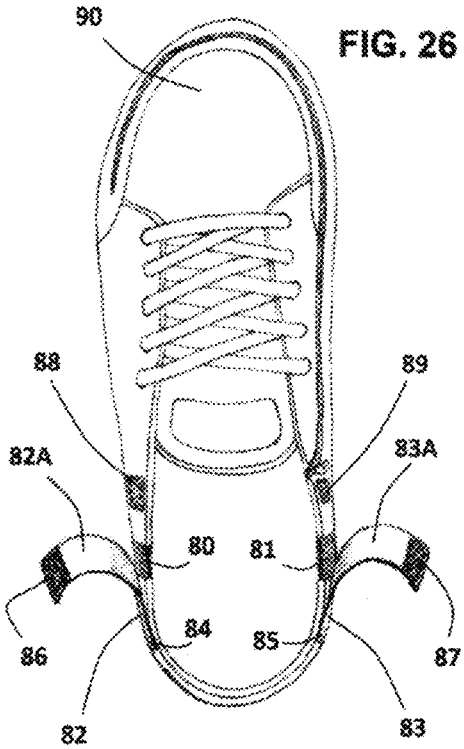
Figure 27:
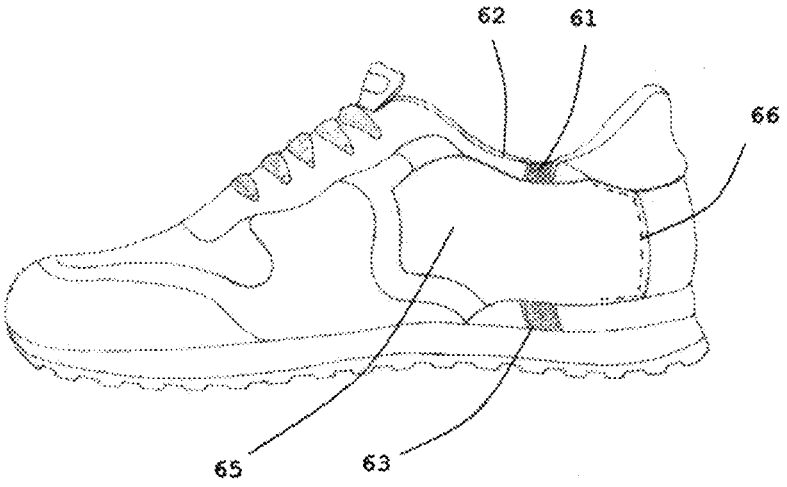
Figure 28:
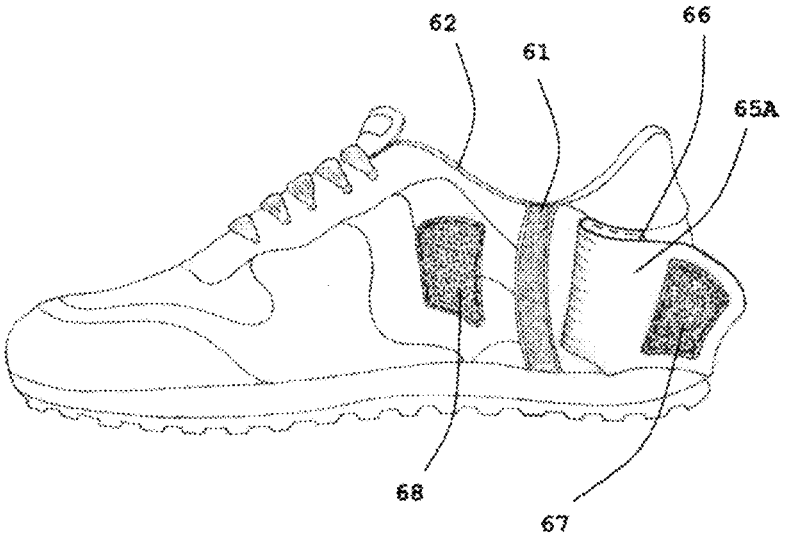

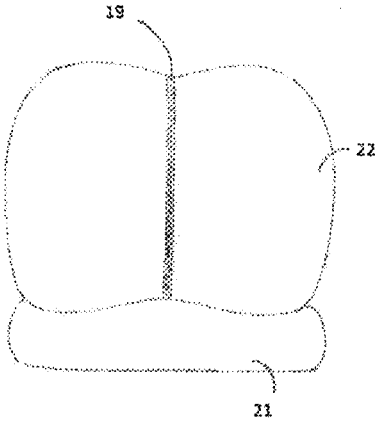
FIG. 11
FIG. 12
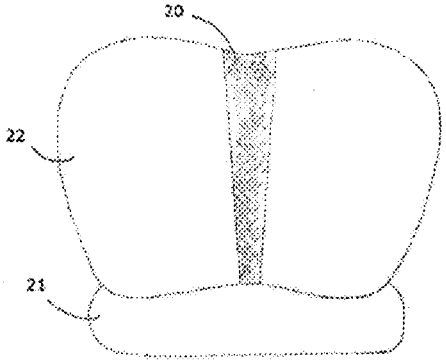

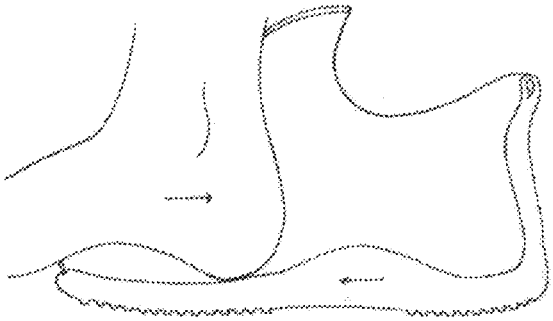
FIG. 16A
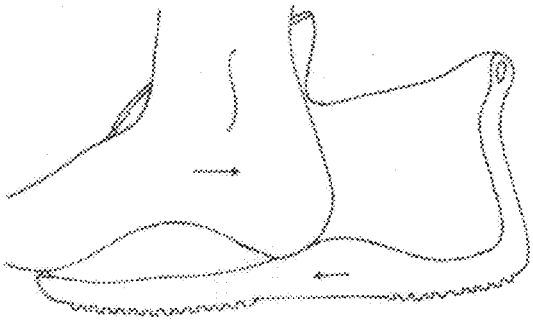
FIG. 16B
FIG. 16C
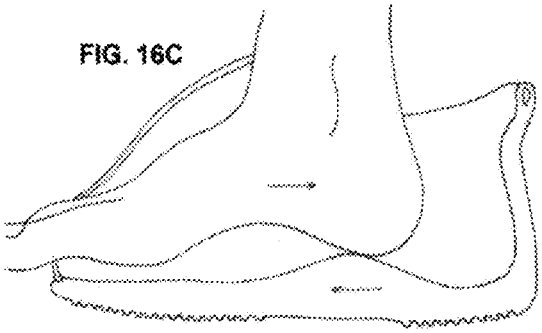
FIG. 16D
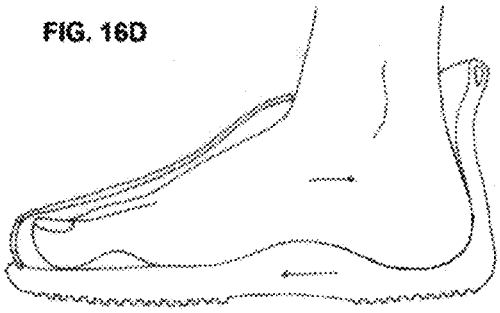

SHOE WITH EXPANDABLE TOP

FIELD AND BACKGROUND OF THE INVENTION

This invention relates to a shoe. More particularly, the invention relates to a shoe which is configured and constructed so that it may be placed on the foot of the wearer in a more convenient manner. While the invention may be used in many applications, and certainly has a mainstream use for all or most people, its particular construction may be of special benefit to handicapped or disabled people. In this regard, the invention offers a simpler and more natural way to place the foot within the shoe, and may be advantageous for people who have a reduced response to touch on the foot, or a loss of muscular control in the foot, are paralyzed at the foot, or have other medical issues with their feet that require them to wear a foot, ankle, or lower leg brace.

A conventional closed shoe comprises a sole and a top member stitched or otherwise fastened to the sole. The top member will typically create a chamber or housing area for the foot, and have an opening through which the foot accesses the chamber. In many shoes, the opening may be of adjustable size so that it can be larger when inserting the foot, and reduced in size when the foot is inside the shoe. The opening is adjusted by the user by means of shoelaces, Velcro straps or elasticized portions around the opening, to name some examples.

The opening in the top member of a conventional shoe is positioned such that the foot must be inserted into the chamber or housing area for the foot through the opening toes first, followed by the remainder of the foot and then the heel is pushed down into the shoe until it contacts the sole. In many cases, this will work well and the average person is able to position and wiggle the toes and foot so that it is properly contained within the generally snug fitting chamber or housing. However, the wearer must have the capacity and ability to flex and move the foot and toes to put on the conventional shoe. This may be a particular challenge for a person who may have muscular weakness of the foot or legs or is in fact paralyzed with no feeling or functional movement in their feet or toes, or those with conditions that require a medical brace for toe, foot, or ankle stability, the aforementioned braces require additional accommodating space in certain areas of the shoe for entry. While a conventional shoe can be large enough to allow a brace to enter the shoe the size required to accommodate a brace would be too large in all the other areas of the shoe. While most people take for granted the ability to use the foot as necessary to put on a shoe, there are many who lack this ability due to foot paralysis or some other medical condition, or young age, and conventional shoes with the type of opening as described above will therefore be difficult to navigate. It is conceivable that a person with a paralyzed foot may be able to squeeze the foot into the shoe, however without the ability to control and straighten their toes when pushing a foot into a shoe would end up with toes being bent over or twisted, the user not even knowing this would nevertheless have to deal with possible consequences including reduced circulation and swelling, swelling which leads to a further reduction in circulation, potential pain, and a deterioration of extremity health. The longer the foot is in an unnatural position the worse the condition becomes.

This invention allows for the entire front and top of the shoe to open up and out of the way thus allowing the wearer to slide the front of the shoe across the bottom of the foot starting at the wearer's heel and moving towards the toes. By moving the shoe in this direction, it automatically maintains the toes in the correct and flat and natural position, which is essential for proper circulation and continued health of the foot, additionally the invention has several areas that are self-expanding and several areas that are wearer adjustable allowing the correct size shoe for the wearer's foot to also expand only in the areas needed for where a brace would be positioned inside the shoe once the shoe is closed.

SUMMARY OF THE INVENTION

According to one aspect of the invention, there is provided a shoe comprising: a sole having an upper surface and a lower surface; a top member having an outer surface and an inner surface and mounted on the sole, the top member and sole defining a space for receiving a foot, the top member further having a foot entry opening; a fastener in the top member extending from the foot entry opening and continuing over the top member such that a portion of the top member is movable between a first position in which the space is substantially closed and a second position in which a portion of the top member is folded back from the sole to provide complete access to the space; and self-expanding areas in different locations of the top member to accommodate different toe, foot, and ankle braces.

In one embodiment, the foot entry opening in the top member is located at one end of the shoe and sized so as to permit the leg or ankle of the wearer to extend therethrough. The fastener may comprise a zipper, a Velcro fastener, a combination thereof, or some other structure such as a snap.

Preferably, the fastener commences in the top member at the opening thereof, extends from the opening towards the sole near the front of the shoe, continues around the front of the top member near the junction of the top member and sole and continues in the top member partially along the opposite side of the shoe.

In one embodiment the top member of the shoe can also incorporate several self-expanding areas on the top member from the toe area towards the foot opening area, these expanding areas allow for braces that cover the top of the wearer's toes and only expand around where the brace needs additional room thus not requiring a completely larger size shoe that the wearer requires.

In another embodiment the top member of the shoe can also incorporate a self-expanding vertical strip in the center of the heel portion of the top member allowing for accommodating an ankle brace, additionally incorporating a lacing around the foot opening to control the heel expansion once the brace is in place inside the shoe.

In another embodiment the top member of the shoe can also incorporate a self-expanding vertical strip in the center of the heel portion of the top member allowing for accommodating an ankle brace, additionally incorporating a securement cover flap secured on one side of the expanding vertical strip and detachably secured on the other side of the expanding vertical strip that enhances support to the expanded area once the brace is in place inside the shoe.

In yet another embodiment the top member of the shoe can also incorporate an additional vertical lacing on the opposite side of the foot opening from the zipper fastener opening position allowing for a more specialized type of brace to be utilized inside the shoe.

In another embodiment the top member has vertical expandable areas on either one or both sides of the foot opening area as well as a securement cover flap for each expandable area which enhances structural stability into the upper edge of the foot opening.

In still another embodiment, the shoe has a heel end, a generally opposite front end, an inner side and an outer side, the opening being located near the heel end, the fastener commencing in the top member at the opening thereof, extends from the opening toward the sole near the front end of the shoe, and continues in the top member around the front end thereof and partially along the opposite side of the shoe.

In still another embodiment the shoe being a tall boot style and facilitating the entire top section of the foot area and up the tall portion of the front and side of the boot opening up and moving off to one side like a flap there is also on one or both sides an expandable area from the sole to above the ankle position area that allows for the wearer to have their brace accommodated for, each expandable area having a cover flap that enhances support to the expanded area once the boot style shoe is in the fastened and closed position and on the wearers foot.

The shoe may comprise many different styles, from boot styles to sneakers styles, and from high heels to casual dress, all of which can utilize one of many fastener options from a zipper to a Velcro type material, the fastening means can be exposed or hidden and the pull tab can be strictly utilitarian or expressingly decorative, furthermore many of these aforementioned styles of shoes can also incorporate laces for further adjusting the fit or for additional fashion.

This invention therefore relates to a shoe with a unique structure and configuration which enables it to be placed on the foot and removed therefrom in a more convenient manner which also facilitates healthy and natural foot and toe placement while also accommodating several types of foot, ankle, and toe support braces.

The invention provides for a shoe having a base or sole, a top mounted on the sole so that sole and top together define a space for receiving a foot, an opening on the top, and fastening means whereby at least a part of the top may be selectively separated from the sole to allow the foot to be inserted into or removed from the shoe, and fastened to the sole when the foot is in the space defined by the shoe so as to keep the foot securely within the space.

For the most part, when a person puts on shoes, he or she without even giving it much conscious thought is holding their toes out straight and sliding the foot into the shoe. Without muscular control, the toes are likely to bend under, fold and bind. When the toes are in a folded position, the entire skeletal structure of the foot must make adjustments. An inherent problem in this regard is the restricted circulation of blood that may occur, and with this restriction comes the swelling of tissue. These conditions may have a domino or compounding effect, in that the more the foot swells, the more restriction is likely, in turn producing yet more swelling. This of course leads to the diminished health of the foot, and the various tissues and components which form it.

When placing the heel of the foot on the sole of a shoe at the front of an open shoe constructed in accordance with the present invention and sliding the shoe forward and/or the foot backward, this action directs the toes to lay out in a flat and normal healthy position, thus maintaining unimpaired circulation and not resulting in any swelling, both of which can occur in conventional shoes with conventional entry procedures. In one embodiment, the zipper when closed is designed to be on one side of the shoe at the opening that encircles the ankle (using the low rise style of shoe as an example in this case), and the zipper tab is pulled at an angle towards the front of the shoe where the top member connects to the sole, around the front of the shoe, and toward and along the other side of the shoe. The zipper and zipper tab can be conveniently located on any part of the shoe so as to give effect to the purpose of the present invention, namely, to move at least a part of the top of the shoe away from the base or sole to provide easy access to the space when inserting the foot into the shoe. As long as the front of the shoe is opened up for heel entry, as will be described further below, the precise positioning of the zipper or other mechanism to effect opening and closing may vary according to the design of the shoe, and the preference of wearers who may have different needs and requirements. Regardless of the shoe style, the opening mechanism may be pulled at an angle towards connection area at the front and then across the entire front of the shoe thus allowing the entire front and top of the shoe to open away much like a flap.

This configuration or platform can be utilized for any and all shoe styles, from sneakers to boots to heels to dress shoes. While most of the accompanying drawings show for the most part a zipper configuration, it is not the only configuration that is available or may be used.

When a person has a disability, either from birth or by accident at some point in life, their needs tend to be viewed through a medical filter only. For example, a person who may have suddenly lost muscular control of his lower extremities would continue to desire normal and conventional comforts, as well as clothing and shoes which may be fashionable and stylish. These needs would not diminish, but often the emphasis is on treatment and rehabilitation while normal creature comforts and preferences may sometimes be overlooked. Those in wheelchairs with limited or no muscular control of their lower extremities still have a need for well-designed and comfortable shoes, and the present invention can be used in a wide range of shoe types and designs, providing practical comfort and access without sacrificing fashion and style, and without the shoe being clearly identifiable as some type of medical device. Those that require a foot, toe, or ankle brace for structural support have an additional layer of complications with a convention shoe being a conventional shoe would need to be several sizes larger than the wearer's foot to accommodate the brace, leaving too much space in the shoe around the foot while also looking abnormally large for the persons physical size and probably drawing unwanted attention.

Therefore, a shoe constructed in accordance with the present invention allows the world of fashion and style to once again be opened up to persons who are disabled or those who are born with such disabilities.

The present invention therefore provides for a shoe which is both a medical device as well as an item of fashion, all in the same product. With this marriage of form following function pre-emptive accommodations in sizing for swelling and incorrect extremity positioning may no longer be required.

In another arena completely, it appears that parents of small children can struggle significantly with putting shoes on little feet, specifically getting little toes to be pointed straight so the shoe can be put on correctly, with the foot and toes in a natural and healthy position when inside the shoe, even more complicated if the youngster has specific health concerns that require a type of foot brace. The utility of this shoe can also be used to accommodate this struggle by removing the need for co-operation with a 2 year old.

The invention claimed is:

1. A shoe comprising:

a sole with an upper surface with an outer edge and a lower surface;

a top member having with a distal front end portion, a proximal heel end portion, a lateral side and a medial side and mounted on the sole, the top member and sole defining a space therebetween configured to receive a foot, the top member with a foot entry opening with a distal end and a proximal end and a medial side and a lateral side, a lower connective edge, a fold back portion, and a fixed portion;

a connection area for connecting the upper surface of the sole at the outer edge thereof and the lower connective edge of the top member, the connection area extending along the outer edge of the upper surface of the sole and the lower connective edge of the top member; and a single fastening means in the form of one continuous zipper fastener located in the top member;

a vertical expandable vent band inserted into the top member material and a horizontal expandable vent band inserted into the top member material, the vertical expandable vent bands and the horizontal expandable vent band located on an opposite side of a zipper fastener starting location, the horizontal expandable vent band inserted above the top member to a sole connection area, the vertical expandable vent band extends from the horizontal expandable vent band at a midpoint of the horizontal expandable vent band to the foot entry opening, the the vertical expandable vent band and the horizontal expandable vent band allowing for the foot entry opening to accommodate and mold around an ankle brace.

2. A shoe as claimed in claim 1, with multiple expandable vent bands inserted into the top member material positioned in several locations across a top of a foot toe area of the top member between the foot toe area towards the foot entry opening and spaced from a medial side to a lateral side of a top member surface at the top of the foot toe area.

3. A shoe as claimed in claim 1, wherein the shoe has a single expandable vent band inserted into the top member material located above the zipper fastener, and transitioning from a starting point in front of the foot entry opening then travelling towards and around the front of the shoe ending on the opposite side of the shoe in a location mirrored to that of a starting location of the single expandable vent band, the single expandable vent band allows the shoe to accommodate a foot brace.

4. A shoe as claimed in claim 1, further comprising a top member opening feature configured to accommodate a foot entry into the shoe, further includes the vertical expandable vent band is inserted into the top member above the connection area of the top member to a sole and vertically to an ankle opening, a horizontal expandable vent band is inserted into the top member positioned above the sole to top member connection point and intersecting the vertical expandable vent band at the midpoint of the horizontal expandable vent band, the vertical expandable vent band and horizontal expandable vent band configuration placed on at least one side of the top member at the ankle opening for accommodating an ankle brace, additionally with lacing eyelets on either side of the inserted vertical expandable vent band in the top member allowing for greater control of the amount of band expansion with the use of a shoe lace tied through the lacing eyelets, the shoe lace also adding additional support to the ankle opening.

5. A shoe as claimed in claim 1, wherein the vertical expandable vent band inserted in a center of the proximal heel end portion of the top member allowing for added internal space for an ankle brace.

6. A shoe as claimed in claim 5 wherein the vertical expandable vent band inserted in the center of the proximal heel end portion of the top member from the sole to the top member connection area vertically to the ankle opening upper edge to provide added internal space for a heel brace, and allowing for expanding where needed, lacing eyelets on either side of the vertical expandable vent band allows the foot entry opening to expand, that expansion is controllable by pulling tight and tying a lace.

7. A shoe as claimed in claim 1 with a foot entry opening in the top member, a forward edge, a rear edge, an inner side edge, and an outer side edge, and further comprises a band of expandable material inserted in a specific area of the top member material, the expandable band configured to expand to accommodate a foot brace and securing with an external securement cover flap, one end of the securement cover flap permanently attached to the top member on one side of the expandable band, hook and loop material permanently attached to the other end of the securement strap allowing for adjustability and releasability of the securement cover strap to a patch of hook and loop material attached to the top member material on the other side of the expandable band.

8. A shoe as claimed in claim 7 with an external securement cover flap securing a front side edge of the top member and a rear side edge of the top member to each other at the foot opening across the expandable vertical band inserted into the top member material.

9. A shoe as claimed in claim 8 wherein the external securement cover flap is attached at a rear end portion of the side of the top member, the top member incorporating the expandable vertical band inserted into the top member material to accommodate a foot brace, adjusted and secured with the external securement cover flap across the expandable vertical band.

10. A shoe as claimed in claim 9 wherein the expandable vertical band inserted into the top member and the external securement cover flap is incorporated on at least one side of the top member from the opening edge of the foot opening vertically down to where the top member connects to the sole.

11. A shoe as claimed in claim 10 wherein the expandable vertical band and the securement cover flap are incorporated on the lateral side of the top member or the medial side of the top member at the foot opening area from the edge of the foot opening vertically to the top member to sole connection point.

12. A shoe as claimed in claim 11 wherein the shoe is a tall boot, the lateral side of the top member or the medial side of the top member are allowed to expand near and around an ankle position area, the securement cover flap positioned at an ankle height area enhancing ankle area structural stability.

13. A shoe comprising;

a sole with an upper surface with an outer edge and a lower surface, a top member with a distal front end portion, a proximal heel end portion, a lateral side and a medial side and mounted on the sole, the top member and the sole defining a space therebetween configured for receiving a foot, the top member with an ankle opening with a distal end and a proximal end and a medial side and a lateral side, a lower connective edge, an open area with a flap or tongue within the open area, an edge of the material on a lateral side and a medial side of the open area including eyelets for laces, the laces passing through the eyelets crossing the open area over the flap or tongue tightening the shoe when the laces are pulled;

a connection area for connecting the upper surface of the sole at the outer edge thereof and the lower connective edge of the top member, the connection area extending along the outer edge of the upper surface of the sole and the lower connective edge of the top member; and an additional single fastening means in the form of one continuous zipper fastener in the top member, the zipper fastener extending from a starting point at the ankle opening on the medial side of the ankle opening, traversing the medial side of the top member at a descending angle directly towards the connection area where the medial side becomes the distal front end portion of the top member continuing across the distal front end portion of the top member at the connection area, to where the distal front end portion becomes the lateral side of the top member and then traversing the lateral side of the top member along the connection area, the zipper fastener travelling in a direction towards the proximal heel end portion of the shoe to a zipper termination point located at the ankle opening on the lateral side of the top member such that the top flap of the top member is movable between a first position in which the space is closed when the zipper fastener is closed to the ankle opening starting point and a second position in which the space is open when the zipper fastener is unzipped to the zipper termination point thereby allowing a top flap of the top member to be folded open to one side to provide foot access to the space when the zipper fastener is open while allowing the laces to remain tied at the preferred tightness of the wearer, a vertical split in the top member at one location of the ankle opening, the vertical split traversing from the top of the ankle opening to the connection area of the top member to the sole, a band of an expandable material inserted into the vertical split of the top member and allowing the size of the ankle opening from the top of the foot opening to the top member to the sole connection point to adjust to accommodate an ankle brace, the ankle opening is further supported with a horizontal securement cover flap with one end permanently attached to the top member on one side of the vertical split, hook and loop material permanently attached to the other end of the securement cover flap allowing for adjustability and releasability of the securement cover flap to a patch of hook and loop material attached to the top member material on the other side of the expandable band.

* * * * *